US010107176B2

(12) United States Patent
Murai et al.

(10) Patent No.: US 10,107,176 B2
(45) Date of Patent: Oct. 23, 2018

(54) COOLING DEVICE OF INTERNAL COMBUSTION ENGINE FOR VEHICLE AND CONTROL METHOD THEREOF

(71) Applicant: Hitachi Automotive Systems, Ltd., Hitachinaka-shi, Ibaraki (JP)

(72) Inventors: Atsushi Murai, Isesaki (JP); Shigeyuki Sakaguchi, Isesaki (JP); Yuichi Toyama, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/555,681

(22) PCT Filed: Mar. 1, 2016

(86) PCT No.: PCT/JP2016/056288

§ 371 (c)(1),
(2) Date: Sep. 5, 2017

(87) PCT Pub. No.: WO2016/143611

PCT Pub. Date: Sep. 15, 2016

(65) Prior Publication Data

US 2018/0038267 A1 Feb. 8, 2018

(30) Foreign Application Priority Data

Mar. 6, 2015 (JP) ..... 2015-045095

(51) Int. Cl.
*F01P 7/14* (2006.01)
*F01P 7/16* (2006.01)
(Continued)

(52) U.S. Cl.
CPC *F01P 7/16* (2013.01); *F01P 3/20* (2013.01); *F01P 7/164* (2013.01); *F01P 7/165* (2013.01);
(Continued)

(58) Field of Classification Search
CPC .... F01P 2007/146; F01P 2025/13; F01P 3/18; F01P 3/20; F01P 7/16; F01P 7/164; F01P 7/165
(Continued)

(56) References Cited

U.S. PATENT DOCUMENTS

2004/0144340 A1* 7/2004 Kilger ..... F01P 7/164 123/41.1
2009/0255488 A1* 10/2009 Shiobara ..... F01P 7/167 123/41.1
(Continued)

FOREIGN PATENT DOCUMENTS

DE 199 51 362 A1 5/2001
EP 1772605 A1 * 4/2007 ..... F01P 7/165
(Continued)

OTHER PUBLICATIONS

Japanese-language Office Action issued in counterpart Japanese Application No. 2015-045095 dated Dec. 19, 2017 with English translation (Five (5) pages).
(Continued)

*Primary Examiner* — Marguerite McMahon
*Assistant Examiner* — Tea Holbrook
(74) *Attorney, Agent, or Firm* — Crowell & Moring LLP

(57) ABSTRACT

The present invention relates to a cooling device of internal combustion engine for vehicle and a control method thereof. The cooling device according to the present invention includes: an electric water pump; a bypass line bypassing a radiator; and a flow rate control valve for controlling a flow rate of cooling water circulating through the bypass line. During a low external air temperature state where the external air temperature is below a threshold, the cooling device increases the temperature of the cooling water by increasing the flow rate of the cooling water circulating
(Continued)

through the bypass line as compared to during a high external air temperature state where the external air temperature is above the threshold, and increases a circulation flow rate of the cooling water by increasing a discharge flow rate of the electric water pump as compared to during the high external air temperature state.

7 Claims, 5 Drawing Sheets

(51) Int. Cl.
*F01P 3/20* (2006.01)
*F01P 5/12* (2006.01)
*F01P 3/18* (2006.01)

(52) U.S. Cl.
CPC . *F01P 3/18* (2013.01); *F01P 5/12* (2013.01); *F01P 2007/146* (2013.01); *F01P 2025/13* (2013.01); *F01P 2060/08* (2013.01)

(58) Field of Classification Search
USPC ..... 123/41.1, 41.02, 41.05, 41.08, 41.09, 123/41.29
See application file for complete search history.

(56) References Cited

U.S. PATENT DOCUMENTS

2011/0120216 A1* 5/2011 Sugimoto ..... F01P 7/164 73/114.68
2012/0024243 A1* 2/2012 Koyashiki ..... F01P 7/165 123/41.1
2012/0210954 A1* 8/2012 Nishikawa ..... F01P 3/02 123/41.08
2013/0025277 A1* 1/2013 Enokijima ..... F01K 23/065 60/615
2014/0262195 A1* 9/2014 Lee ..... B60K 11/02 165/200

FOREIGN PATENT DOCUMENTS

JP 61-101617 A 5/1986
JP 2006-112344 A 4/2006
JP 2014-20229 A 2/2014

OTHER PUBLICATIONS

International Preliminary Report on Patentability (PCT/IB/338 & PCT/IB/373) issued in PCT Application No. PCT/JP2016/056288 dated Sep. 21, 2017, including English translation of document C2 (Japanese-language Written Opinion (PCT/ISA/237)) previously filed on Sep. 5, 2017 (8 pages).
International Search Report (PCT/ISA/210) issued in PCT Application No. PCT/JP2016/056288 dated May 17, 2016 with English translation (Two (2) pages).
Japanese-language Written Opinion (PCT/ISA/237) issued in PCT Application No. PCT/JP2016/056288 dated May 17, 2016 with English translation (Eight (8) pages).
German-language Office Action issued in counterpart German Application No. 112016001062.1 dated Jun. 4, 2018 with partial English translation (seven (7) pages).

* cited by examiner

COOLING DEVICE OF INTERNAL COMBUSTION ENGINE FOR VEHICLE AND CONTROL METHOD THEREOF

TECHNICAL FIELD

The present invention relates to a cooling device of an internal combustion engine for vehicle and to a control method thereof, and specifically relates to a technique for controlling cooling water circulation when the exterior air temperature is low.

BACKGROUND ART

Patent Document 1 discloses a thermostat for use in cooling water. The thermostat maintains the cooling water temperature at a slightly higher level in winter when the exterior air temperature is low.

REFERENCE DOCUMENT LIST

Patent Document

Patent Document 1: JP S61-101617 A

SUMMARY OF THE INVENTION

Problems to be Solved by the Invention

A cooling water circulation passage in a cooling device of an internal combustion engine for vehicle may include heat exchangers for heating, such as an oil warmer for heating hydraulic oil of a hydraulic mechanism including a hydraulic automatic transmission, and a heater core for vehicle air heating.

The heating performances of these heat exchangers for heating depend on the external air temperature. Accordingly, in winter when the external air temperature is low, the temperatures of oil and air having passed through the heat exchangers may possibly be maintained at lower levels than in summer when the external air temperature is high, if the cooling water temperature is the same. In addition, in winter when the external air temperature is low, the temperature of lubricating oil for internal combustion engine may possibly also be lower than when the external air temperature is high (in summer).

Here, increasing the cooling water temperature when the external air temperature is low as compared to when the external air temperature is high can bring the temperatures of oil and the like having passed through the heat exchangers close to levels achieved when the external air temperature is high.

However, increasing the cooling water temperature, i.e., increasing the cylinder head temperature raises the likelihood of abnormal combustion such as knocking. Thus, such cooling water temperature increase is permitted only within a range that ensures the occurrence of abnormal combustion is sufficiently reduced or prevented.

Accordingly, when the external air temperature is low, increasing the cooling water temperature alone can be insufficient to cause the heat exchangers for heating to fully demonstrate their heating performances, and thus creating problems such as deteriorating air heating performance, and being incapable of sufficiently decreasing friction in the internal combustion engine and the transmission and thus deteriorating the fuel economy.

In view of the above, an object of the present invention is to provide a cooling device of an internal combustion engine for vehicle and a control method thereof, which are capable of improving engine warm-up performance while sufficiently reducing or preventing the occurrence of abnormal combustion when the external air temperature is low.

Means for Solving the Problems

To this end, during a low external air temperature state where an external air temperature is below a threshold, a cooling device of an internal combustion engine for vehicle according to the present invention increases a circulation flow rate of cooling water as well as a temperature of the cooling water as compared to during a high external air temperature state where the external air temperature is above the threshold.

A control method for a cooling device of an internal combustion engine for vehicle according to the present invention is a control method for a cooling device comprising: an electric water pump for circulating cooling water; a bypass line bypassing a radiator; and a flow rate control valve for controlling a flow rate of the cooling water circulating through the bypass line, the control method comprising the steps of: increasing a temperature of the cooling water during a low external air temperature state where an external air temperature is below a threshold as compared to during a high external air temperature state where the external air temperature is above the threshold, by controlling the flow rate control valve so as to increase the flow rate of the cooling water circulating through the bypass line during the low external air temperature state as compared to during the high external air temperature state; and increasing a circulation flow rate of the cooling water during the low external air temperature state as compared to during the high external air temperature state by increasing a discharge flow rate of the electric water pump during the low external air temperature state as compared to during the high external air temperature state.

Effects of the Invention

The rate of heat radiation through heat exchange increases as an inlet temperature increases and as a cooling water flow rate increases. According to the invention as described above, the rate of heat radiation is increased by increasing the cooling water temperature, which corresponds to the inlet temperature, and increasing the circulation flow rate of the cooling water, which corresponds to the cooling water flow rate. Thus, during the low external air temperature state, the temperature of fluid heated by the cooling water in the heat exchangers for heating can be sufficiently increased without excessively raising the cooling water temperature. This provides effects such as decreasing friction in the internal combustion engine, and thus improves its fuel economy.

MODES FOR CARRYING OUT THE INVENTION

An embodiment of the present invention will be described below.

Figure 1:
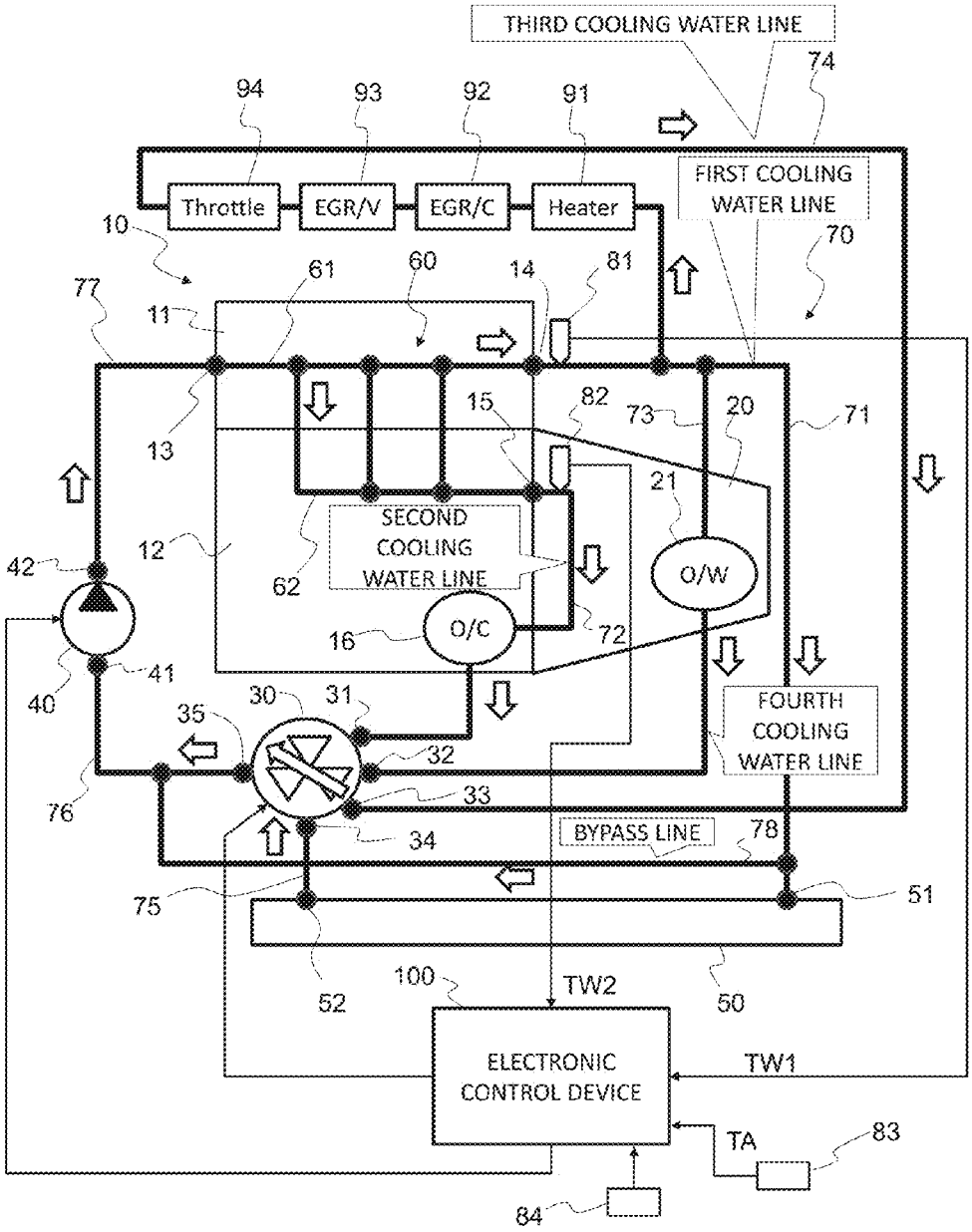
FIG. 1 is a schematic system view of a cooling device of an internal combustion engine according to an embodiment of the present invention.

FIG. 1 illustrates the configuration of an example of a cooling device of an internal combustion engine for vehicle according to the present invention.

As used herein, the term "cooling water" encompasses various coolants used in a cooling device of an internal combustion engine for vehicle, such as antifreeze coolants standardized under Japanese Industrial Standard K 2234 (Engine antifreeze coolants).

An internal combustion engine 10 for vehicle has a cylinder head 11 and a cylinder block 12. A transmission 20, which is an example of a power train system, is coupled to the output shaft of internal combustion engine 10. The output of transmission 20 is transmitted to drive wheels (not illustrated in the drawings) of the vehicle.

Internal combustion engine 10 is cooled by a water-cooled cooling device which circulates cooling water. The cooling device includes a flow rate control valve 30 actuated by an electric actuator, an electric water pump 40 driven by an electric motor, a radiator 50, a cooling water passage 60 provided in internal combustion engine 10, and pipes 70 connecting these components.

Internal combustion engine 10 is provided with a head cooling water passage 61, which serves as part of a cooling water passage 60. Head cooling water passage 61 extends in cylinder head 11 so as to connect a cooling water inlet 13 to a cooling water outlet 14 which are provided to cylinder head 11. In cylinder head 11, cooling water inlet 13 is provided at one end in the cylinder arrangement direction, and cooling water outlet 14 is provided at the other end in the cylinder arrangement direction.

Internal combustion engine 10 is also provided with a block cooling water passage 62 which serves as part of cooling water passage 60. Block cooling water passage 62 branches off from head cooling water passage 61 and enters cylinder block 12 so as to extend in cylinder block 12 and to be connected to a cooling water outlet 15 provided to cylinder block 12. In cylinder block 12, cooling water outlet 15 is provided at an end, on the same side where cooling water outlet 14 of head cooling water passage 61 is provided, in the cylinder arrangement direction.

In this cooling device illustrated in FIG. 1, the cooling water is supplied through cylinder head 11 to cylinder block 12. The cooling water having passed through cylinder head 11 is discharged from cooling water outlet 14. The cooling water having passed through cylinder head 11 and then through cylinder block 12 is discharged from cooling water outlet 15.

To cooling water outlet 14 of cylinder head 11, one end of a first cooling water pipe 71 constituting a first cooling water line is connected. The other end of first cooling water pipe 71 is connected to a cooling water inlet 51 of radiator 50.

To cooling water outlet 15 of cylinder block 12, one end of a second cooling water pipe 72 constituting a second cooling water line is connected. The other end of second cooling water pipe 72 is connected to a first inlet port 31 among four inlet ports 31 to 34 of flow rate control valve 30.

In the middle of second cooling water pipe 72, an oil cooler 16 for cooling lubricating oil for internal combustion engine 10 is provided. Oil cooler 16 exchanges heat between the cooling water flowing through second cooling water pipe 72 and the lubricating oil for internal combustion engine 10.

A third cooling water pipe 73 constituting a fourth cooling water line is connected at one end to first cooling water pipe 71 and at the other end to second inlet port 32 of flow rate control valve 30. In the middle of third cooling water pipe 73, an oil warmer 21 is provided which is a heat exchanger for heating hydraulic oil of transmission 20 being a hydraulic mechanism.

Oil warmer 21 exchanges heat between the cooling water flowing through third cooling water pipe 73 and the hydraulic oil of transmission 20. In other words, third cooling water pipe 73 allows the cooling water having passed through cylinder head 11 to be partially diverted and introduced into water-cooled oil warmer 21 so as to heat the hydraulic oil in oil warmer 21.

A fourth cooling water pipe 74 constituting a third cooling water line is connected at one end to first cooling water pipe 71, and at the other end to third inlet port 33 of flow rate control valve 30. Various heat exchanging devices are disposed on fourth cooling water pipe 74.

The heat exchanging devices disposed on fourth cooling water pipe 74 are, in the order from upstream to downstream, a heater core 91 for vehicle air heating, a water-cooled EGR cooler 92, an exhaust gas recirculation control valve 93, and a throttle valve 94. EGR cooler 92 and exhaust gas recirculation control valve 93 constitute an exhaust gas recirculation device of internal combustion engine 10. Throttle valve 94 regulates the amount of air intake into internal combustion engine 10.

Heater core 91, which is a heat exchanger for heating, exchanges heat between the cooling water flowing through fourth cooling water pipe 74 and air for air-conditioning so as to heat the air for air-conditioning.

EGR cooler 92 exchanges heat between the cooling water flowing through fourth cooling water pipe 74 and the exhaust gas recirculated into an intake system of internal combustion engine 10 by the exhaust gas recirculation device so as to lower the temperature of the exhaust gas recirculated into the intake system.

Exhaust gas recirculation control valve 93 for regulating the recirculation amount of exhaust gas and throttle valve 94 for regulating the amount of air intake into internal combustion engine 10 are heated by exchanging heat with the cooling water flowing through fourth cooling water pipe 74. Heating exhaust gas recirculation control valve 93 and throttle valve 94 with the cooling water prevents the freeze of moisture in the exhaust gas around exhaust gas recirculation control valve 93 as well as moisture in the intake air around throttle valve 94.

As described above, fourth cooling water pipe 74 allows the cooling water having passed through cylinder head 11 to be partially diverted and introduced into heater core 91, EGR cooler 92, exhaust gas recirculation control valve 93, and throttle valve 94 so as to exchange heat therewith.

A fifth cooling water pipe 75 is connected at one end to a cooling water outlet 52 of radiator 50, and at the other end to fourth inlet port 34 of flow rate control valve 30.

Flow rate control valve 30 has a single outlet port 35. A sixth cooling water pipe 76 is connected at one end to outlet port 35, and at the other end to an intake port 41 of water pump 40.

A seventh cooling water pipe 77 is connected at one end to a discharge port 42 of water pump 40, and at the other end to cooling water inlet 13 of cylinder head 11.

An eighth cooling water pipe 78 (bypass pipe) is connected at one end to first cooling water pipe 71, and at the other end to sixth cooling water pipe 76. Specifically, in first cooling water pipe 71, the point where eighth cooling water pipe 78 is connected is located downstream to the point connected to third cooling water pipe 73 and downstream to the point connected to fourth cooling water pipe 74.

As described above, flow rate control valve 30 has four inlet ports 31 to 34 and single outlet port 35. Cooling water pipes 72, 73, 74 and 75 are respectively connected to inlet ports 31 to 34, and sixth cooling water pipe 76 is connected to outlet port 35.

Flow rate control valve 30 is a rotational flow channel switching valve that includes a stator having ports formed therein, and a rotor having flow channels formed therein and being fitted in the stator. When flow rate control valve 30 is actuated by the electric actuator such as an electric motor, the electric actuator rotationally drives the rotor, thereby changing the angle of the rotor relative to the stator.

In rotational flow rate control valve 30, the opening area ratio of four inlet ports 31 to 34 changes in accordance with the rotor angle. The ports in the stator and the flow channels in the rotor are adapted such that a desirable opening area ratio, in other words, a desirable flow rate ratio among the cooling water lines may be achieved through selection of the rotor angle.

In the cooling device with the above configuration, head cooling water passage 61 and first cooling water pipe 71 constitute the first cooling water line, which is routed by way of cylinder head 11 and radiator 50. Block cooling water passage 62 and second cooling water pipe 72 constitute the second cooling water line, which is routed by way of cylinder block 12 while bypassing radiator 50.

Head cooling water passage 61 and fourth cooling water pipe 74 constitute the third cooling water line, which is routed by way of cylinder head 11 and heater core 91 while bypassing radiator 50. Head cooling water passage 61 and third cooling water pipe 73 constitute fourth cooling water line, which is routed by way of cylinder head 11 and oil warmer 21 of transmission 20 while bypassing radiator 50.

In addition, eighth cooling water pipe 78 allows the cooling water flowing from cylinder head 11 to radiator 50 through the first cooling water line to be partially diverted to flow through eighth cooling water pipe 78. The diverted flow of cooling water bypasses radiator 50, and enters back the first cooling water line downstream to an outlet of flow rate control valve 30.

As described above, the inlet ports of flow rate control valve 30 are connected respectively to outlets of the first to fourth cooling water lines, and the outlet port of flow rate control valve 30 is connected to intake port 41 of water pump 40.

Flow rate control valve 30 is a flow channel switching mechanism for controlling the supply rates of the cooling water respectively to the first to fourth cooling water lines, in other words, cooling water allocation ratio between the first to fourth cooling water lines, by regulating the opening areas of the respective outlets of the first to fourth cooling water lines.

Flow channel switching patterns enabled by flow rate control valve 30 are categorized roughly into four patterns, i.e., first to fourth flow channel switching patterns as will be briefly described below.

When the rotor angle is within a predetermined angle range from a reference angular position at which the rotor is regulated by a stopper, flow rate control valve 30 is switched to a first flow channel switching pattern in which all inlet ports 31 to 34 are closed.

Note that the conditions in which all inlet ports 31 to 34 are closed in the first flow channel switching pattern include not only the condition in which the opening area of each of inlet ports 31 to 34 is zero. These conditions also include the conditions in which the opening area of each of inlet ports 31 to 34 is the minimum value which causes a small leak of the cooling water from inlet ports 31 to 34.

Note also that the rotor angle used herein indicates a rotation angle from the reference angular position.

When the rotor angle of flow rate control valve 30 is increased to greater than the angle range for the first flow channel switching pattern, flow rate control valve 30 is switched to a second flow channel switching pattern. In the second flow channel switching pattern, the opening area of third inlet port 33 connected to the outlet of the heater-core cooling water line (third cooling water line) increases to a predetermined extent of opening.

The predetermined extent of opening of third inlet port 33 in the second flow channel switching pattern is a medium opening area that is smaller than the maximum opening area of third inlet port 33, but is the maximum extent of opening during the second flow channel switching pattern.

When the rotor angle is further increased to greater than the angle range for the second flow channel switching pattern within which third inlet port 33 is opened to the predetermined extent, flow rate control valve 30 is switched to a third flow channel switching pattern. In the third flow channel switching pattern, first inlet port 31 connected to the outlet of the block cooling water line (second cooling water line) opens, and the opening area of first inlet port 31 gradually increases as the rotor angle increases.

When the rotor reaches an angular position at which the rotor angle is greater than when first inlet port 31 starts to open, flow rate control valve 30 is switched to a fourth flow channel switching pattern. In the fourth flow channel switching pattern, second inlet port 32 connected to the outlet of the power-transmission-system cooling water line (fourth cooling water line) opens to a predetermined extent of opening.

The predetermined extent of opening of second inlet port 32 in the fourth flow channel switching pattern is a medium opening area that is smaller than the maximum opening area of second inlet port 32, but is the maximum extent of opening during the fourth flow channel switching pattern.

When the rotor reaches an angular position at which the rotor angle is greater than when second inlet port 32 opens to the predetermined extent, flow rate control valve 30 is switched to a fifth flow channel switching pattern. In the fifth flow channel switching pattern, fourth inlet port 34 connected to the outlet of a radiator cooling water line (first cooling water line) opens, and the opening area of fourth inlet port 34 gradually increases as the rotor angle increases.

The opening area of fourth inlet port 34 is set to be smaller than the opening area of first inlet port 31 at the start of opening of fourth inlet port 34, and to gradually increase to greater than the opening area of first inlet port 31 as the rotor angle increases.

Electric water pump 40 and flow rate control valve 30 described above are controlled by an electronic control device (control unit) 100. Electronic control device 100 includes a microcomputer including a CPU, a ROM, a RAM, and the like.

Electronic control device 100 receives measurement signals from various sensors for sensing operating states and conditions and the like of the cooling device. Based on these measurement signals, electronic control device 100 then calculates operation variables, and outputs operation signals indicating the operation variables to electric water pump 40 and the actuator for flow rate control valve 30. In this way, electronic control device 100 controls the discharge flow rate of electric water pump 40, and controls the rotor angle of flow rate control valve 30 so as to control the flow rate ratio between the cooling water lines.

The sensors that output the measurement signals to electronic control device 100 include a first temperature sensor 81, a second temperature sensor 82, and an external air temperature sensor 83. First temperature sensor 81 measures a temperature of the cooling water in first cooling water pipe 71 near cooling water outlet 14, i.e., a cooling water temperature TW1 near the outlet of cylinder head 11. Second temperature sensor 82 measures a temperature of the cooling water in second cooling water pipe 72 near cooling water outlet 15, i.e., a cooling water temperature TW2 near the outlet of cylinder block 12. External air temperature sensor 83 measures an external air temperature TA.

In addition, electronic control device 100 receives a signal from an engine switch (ignition switch) 84 for turning internal combustion engine 10 on and off.

Next, flow channel switching characteristics of flow rate control valve 30 in the process of warming up internal combustion engine 10 will be described with reference to FIG. 2.

At the cold start of internal combustion engine 10, electronic control device 100 controls flow rate control valve 30 such that its rotor angle corresponds to the predetermined position at which all inlet ports 31 to 34 are closed. This circulates the cooling water by way of cylinder head 11 while bypassing radiator 50.

The term "cold start" used herein indicates the state where internal combustion engine 10 is started up under the conditions where cooling water temperatures TW1, TW2 are lower than temperatures for determining cold engine.

While circulating bypassing radiator 50, the cooling water absorbs heat from internal combustion engine 10, and increases in temperature. Then (at time point t1 of FIG. 2), the water temperature TW1 at the cylinder head outlet, which is measured by first temperature sensor 81, reaches a temperature that indicates the completion of the warm-up of cylinder head 11. In response, electronic control device 100 increases the rotor angle of flow rate control valve 30 until the rotor reaches the angular position at which the heater-core cooling water line (third inlet port 33) opens, thereby starting the cooling water supply to heater core 91, EGR cooler 92, exhaust gas recirculation control valve 93, and throttle valve 94.

Then (at time point t2 of FIG. 2), the water temperature TW2 at the cylinder block outlet, which is measured by second temperature sensor 82, reaches a preset temperature. In response, electronic control device 100 increases the rotor angle until the rotor reaches the angular position at which the block cooling water line opens, thereby starting the cooling water supply to cylinder block 12.

Then (at time point t3 of FIG. 2), the water temperature TW2 at the cylinder block outlet increases by a predetermined temperature difference from the start of the cooling water supply to cylinder block 12, and thus reaches approximately a target temperature TT2. In response, electronic control device 100 increases the rotor angle until the rotor reaches the angular position at which the power-transmission-system cooling water line opens, thereby starting the cooling water supply to oil warmer 21.

In this way, internal combustion engine 10 is warmed up. Upon the completion of the warm-up, electronic control device 100 increases the rotor angle until the rotor reaches the angular position at which the radiator cooling water line opens (at time point t4 of FIG. 2). After that, electronic control device 100 regulates the opening area of the radiator cooling water line, i.e., regulates the flow rate of the cooling water circulating by way of radiator 50, in accordance with increase in the water temperatures so as to maintain the water temperature TW1 at the cylinder head outlet at approximately a target temperature TT1, and to maintain the water temperature TW2 at the cylinder block outlet at the target temperature TT2 that is higher than the target temperature TT1 for cylinder head 11.

Thus, electronic control device 100 regulates the temperatures of cylinder head 11 and cylinder block 12 by increasing the rotor angle of flow rate control valve 30 along with the progression of the warm-up of internal combustion engine 10, and by regulating the opening area of the radiator cooling water line after the completion of the engine warm-up.

Along with controlling the rotor angle of flow rate control valve 30 in accordance with water temperature increase, electronic control device 100 also increases the discharge flow rate of electric water pump 40 in accordance with water temperature increase. Thereby, while accelerating the engine warm-up, electronic control device 100 prevents engine overheating, i.e., prevents the engine temperature from exceeding its target temperature.

Specifically, during the period from time point t0 to time point t1, i.e., the period until when the water temperature TW1 at the cylinder head outlet reaches the temperature that indicates the completion of the warm-up of cylinder head 11, the discharge flow rate of electric water pump 40 is maintained at approximately the minimum flow rate. Then, after time point t1, the discharge flow rate is increased to a predetermined flow rate f1, which is greater than the minimum flow rate.

While the discharge flow rate is maintained at the predetermined flow rate f1, the water temperature TW2 at the cylinder block outlet reaches the preset temperature at time point t2. In response, the discharge flow rate of electric water pump 40 is gradually increased in accordance with increase in opening area of the block cooling water line.

Then, at time point t3 when power-transmission-system cooling water line opens, the discharge flow rate of electric water pump 40 is increased in response to the start of the cooling water supply to the power-transmission-system cooling water line. After that, the discharge flow rate of electric water pump 40 is increased or decreased so as to maintain the water temperatures TW1, TW2 at approximately their target temperatures.

Furthermore, electronic control device 100 performs different controls on electric water pump 40 and flow rate control valve 30 depending on whether the external air temperature TA is below or above a threshold SL (threshold SL=0° C., for example). The state where the external air temperature TA is below the threshold SL is referred herein to as low external air temperature state, and the state where the external air temperature TA is above the threshold SL is referred herein to as high external air temperature state (ordinary temperature state, or normal temperature state).

Figure 2:
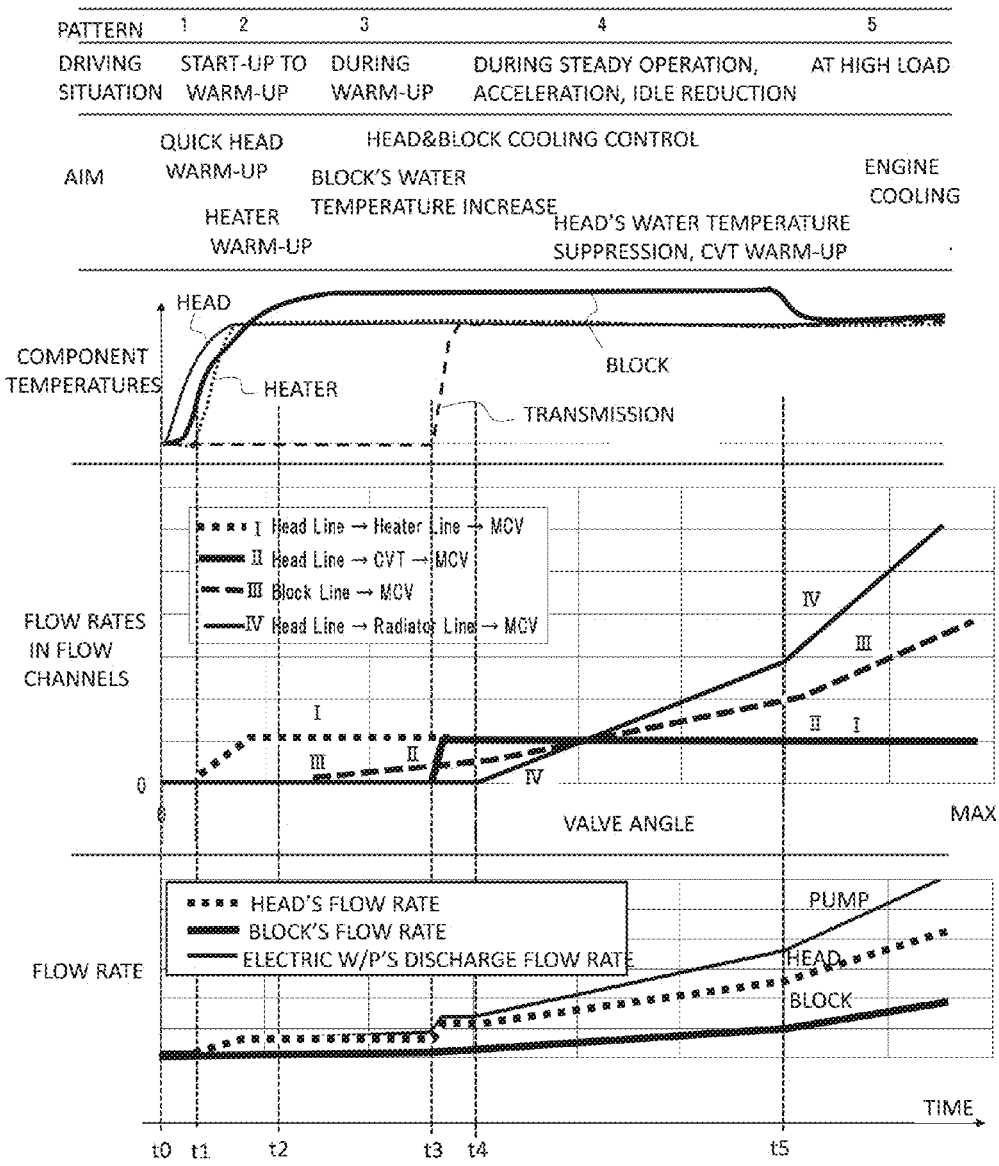
FIG. 2 is a time chart illustrating control characteristics of a flow rate control valve according to an embodiment of the present invention.

The control characteristics of FIG. 2 represent those in the high external air temperature state.

Figure 3:
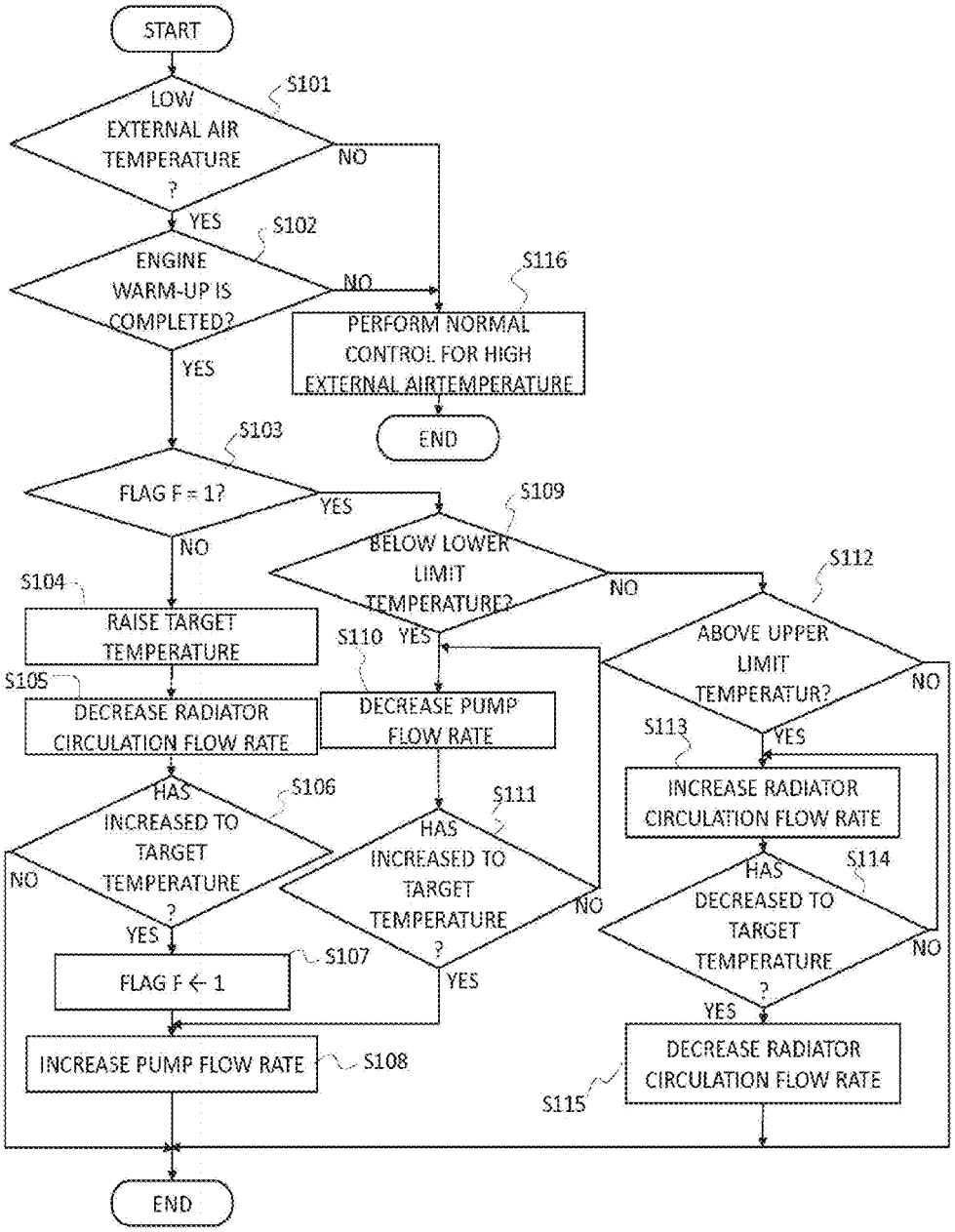
FIG. 3 is a flowchart illustrating a flow of controlling the flow rate control valve and an electric water pump during a low external air temperature state according to an embodiment of the present invention.

The flowchart of FIG. 3 illustrates a flow of how electronic control device 100 controls electric water pump 40 and flow rate control valve 30 after engine warm-up during the low external air temperature state.

Electronic control device 100 conducts the routine illustrated in the flowchart of FIG. 3 as interrupt processing with predetermined time intervals.

In step S101 in the flowchart of FIG. 3, electronic control device 100 compares the external air temperature TA measured by external air temperature sensor 83 with the threshold SL for determining that internal combustion engine 10 is in the low external air temperature state.

When it is determined that the external air temperature TA is above the threshold SL, i.e., that internal combustion engine 10 is in the high external air temperature state, the operation proceeds to step S116. In step S116, electronic control device 100 performs normal control adapted to the high external air temperature state. The time chart of FIG. 2 illustrates an example of the normal control performed in step S116.

On the other hand, when it is determined that the external air temperature TA is not above the threshold SL, i.e., that internal combustion engine 10 is in the low external air temperature state, the operation proceeds to step S102. In step S102, electronic control device 100 determines whether the warm-up of internal combustion engine 10 is completed. When the warm-up is completed, the cooling water temperatures reach their respective target temperatures (temperatures for determining warm-up completion).

In step S102, by determining whether the cooling water temperatures TW1, TW2 have reached their respective target temperatures TT1, TT2, electronic control device 100 detects whether the warm-up of internal combustion engine 10 is completed. In other words, in step S102, electronic control device 100 determines whether the cooling water temperature state at time point t3 of FIG. 2 is established.

When it is determined that the warm-up of internal combustion engine 10 is not completed yet, the operation proceeds to step S116. In step S116, electronic control device 100 performs normal control adapted to the high external air temperature state.

On the other hand, when it is determined that internal combustion engine 10 is in the low external air temperature state, and that the warm-up of internal combustion engine 10 is not completed yet, the operation proceeds to step S103.

In step S103, electronic control device 100 checks a flag F, which rises upon performing the control for increasing the discharge flow rate of electric water pump 40.

The initial value of the flag F is "0", and the flag F is configured to rise to "1" when the discharge flow rate of electric water pump 40 is increased as compared to that in the high external air temperature state, as will be described later.

When the flag F is "0" immediately after the completion of the engine warm-up, the operation proceeds to step S104. In S104, electronic control device 100 changes the target temperatures to target temperatures TTL1, TTL2, which are adapted for the low external air temperature state. The target temperatures TTL1, TTL2 are higher respectively than target temperatures TT1, TT2, which are used in step S116 during the high external air temperature state, by a predetermined temperature difference ΔT (ΔT=4° C., for example) (TTL1=TT1+ΔT, TTL2=TT2+ΔT).

In other words, during the low external air temperature state, electronic control device 100 changes the target temperatures of the cooling water after engine warm-up to values higher than those during the high external air temperature state, so as to increase the cooling water temperature as compared to during the high external air temperature state.

Then, the operation proceeds to step S105. In step S105, electronic control device 100 maintains the rotor angle of flow rate control valve 30 corresponding to the angular position at which the radiator cooling water line starts to open. Thereby, electronic control device 100 maintains the flow rate of the cooling water circulating by way of radiator 50 at the minimum rate (including zero).

During the high external air temperature state, electronic control device 100 maintains the cooling water temperature at a level measured when the engine warm-up is just completed by increasing the flow rate of the cooling water circulating through the radiator cooling water line so as to suppress the temperature rise of the cooling water,. In contrast, as described above, during the low external air temperature state, electronic control device 100 increases the cooling water temperature as compared to when the engine warm-up is just completed by maintaining the flow rate of the cooling water circulating by way of radiator 50 at the minimum rate (including zero) until the temperature of the cooling water rises.

In other words, during the low external air temperature state, electronic control device 100 decreases the flow rate of the cooling water circulating by way of radiator 50 and increases the flow rate of the cooling water circulating through the bypass line which bypasses radiator 50, as compared to during the high external air temperature state.

Here, the radiator cooling water line through which the cooling water circulates by way of radiator 50 is the first cooling water line, and the line through which the cooling water circulates bypassing radiator 50 includes the second to fourth cooling water lines and eighth cooling water pipe 78.

While the radiator circulation flow rate is maintained at the minimum rate, the operation proceeds to step S106. In step S106, electronic control device 100 determines whether the cooling water temperatures TW1, TW2 have increased to near their target temperatures TTL1, TTL2.

Specifically, in step S106, electronic control device 100 may determine whether both the condition that the cooling water temperature TW1 reaches near the target temperature TTL1 and the condition that the cooling water temperature TW2 reaches the target temperature TTL2 are satisfied. Alternatively, electronic control device 100 may determine whether at least one of the cooling water temperatures TW1, TW2 reaches its target temperature TTL1, TTL2. Still alternatively, electronic control device 100 may set a target average water temperature TTAV for during the low external air temperature state, and determine whether the average of the cooling water temperatures TW1, TW2 reaches the target average water temperature TTAV.

Still alternatively, when internal combustion engine 10 has a single cooling water outlet, and a cooling device having a water temperature sensor disposed at this outlet is used, electronic control device 100 may determine whether the cooling water temperature at the outlet reaches its target temperature for during the low external air temperature state, in step S106.

When it is determined that the cooling water temperatures TW1, TW2 has not yet reached near the target temperatures TTL1, TTL2, i.e., while the cooling water temperatures TW1, TW2 are below the target temperatures TTL1, TTL2, the interrupt processing illustrated in the flowchart of FIG. 3 ends. Thereby, electronic control device 100 maintains the radiator circulation flow rate at the minimum rate.

Maintaining the radiator circulation flow rate at the minimum rate can gradually increase the cooling water temperatures TW1, TW2. Then, when it is determined that the cooling water temperatures TW1, TW2 reach near the target temperatures TTL1, TTL2, the operation proceeds to step S107.

In step S107, electronic control device 100 raises the flag F to "1".

Then, the operation proceeds to step S108. In step S108, electronic control device 100 increases the discharge flow rate of electric water pump 40 from the normal discharge flow rate determined in the control for during the high external air temperature state (i.e., discharge flow rate during the high external air temperature state) by a predetermined value.

As a result, during the low external air temperature state, the cooling water is supplied to the heat exchangers such as heater core 91 for vehicle air heating and oil warmer 21 for transmission 20 at a higher temperature and a greater flow rate than during the high external air temperature state.

The rate of heat radiation Q (W) from the heat exchangers such as heater core 91 is expressed by the following equation (1):

$$Q=\rho cV(Tin-Tout) \qquad \text{Equation (1)}$$

where ρ represents a fluid density (kg/L), c represents specific heat of fluid (kcal/(kg*° C.)), V represents a fluid flow rate (L/min), Tin represents an inlet fluid temperature (° C.), and Tout represents an outlet fluid temperature (° C.).

As described above, during the low external air temperature state, the cooling water temperature and the discharge flow rate of electric water pump 40 (i.e., the circulation flow rate of the cooling water) are increased as compared to during the high external air temperature state. This increases the fluid inlet temperature Tin and the fluid flow rate V, thus increasing the rate of heat radiation Q, in Equation (1) above.

For example, assume here the case where the rate of heat radiation Q is constant irrespective of the external air temperature. In such case, the temperatures in internal combustion engine 10 such as hydraulic oil temperature decrease during the low external air temperature state as compared to during the high external air temperature state. This increases friction in transmission 20, thus deteriorating the fuel economy of internal combustion engine 10.

In contrast, increasing the rate of heat radiation Q during the low external air temperature state as compared to during the high external air temperature state will enhance the heating performances of the heat exchangers for heating, such as heater core 91 and oil warmer 21 during the low external air temperature state. Accordingly, even during the low external air temperature state, the temperatures in internal combustion engine 10 such as hydraulic oil temperature in transmission 20 are increased close to those during the high external air temperature state. This can sufficiently minimize, for example, friction in transmission 20, thus improving the fuel economy of internal combustion engine 10, during the low external air temperature state.

Moreover, increasing the discharge flow rate of electric water pump 40 in addition to increasing the cooling water temperature in order to increase the rate of heat radiation Q during the low external air temperature state allows for further increasing the rate of heat radiation Q while reducing or preventing abnormal combustion in internal combustion engine 10, and allows for further increasing the hydraulic oil temperature to enhance its friction reducing effect.

For example, assume here the case where, during the low external air temperature state, only the cooling water temperature (° C.) is increased as compared to during the high external air temperature state while the discharge flow rate of electric water pump 40 (L/min) is maintained at approximately the same level as during the high external air temperature state. In such case as well, the rate of heat radiation Q (W) will be increased. However, as Equation (1) demonstrates, in order to increase the rate of heat radiation Q (W) to approximately the same level as that achieved by increasing both the cooling water temperature and the discharge flow rate of electric water pump 40, the cooling water temperature needs to be more increased.

Here, as the cooling water temperature in the cooling device of internal combustion engine 10 increases, in other words, the cylinder head temperature increases, abnormal combustion such as knocking and pre-ignition is more likely to occur. To avoid this, an increase in the cooling water temperature needs to be limited to below an upper limit temperature that ensures the occurrence of abnormal combustion is sufficiently reduced or prevented. Thus, the maximum value for the rate of heat radiation Q when only the cooling water temperature (° C.) is increased as compared to during the high external air temperature state while the discharge flow rate of electric water pump 40 (L/min) is maintained at approximately the same level as during the high external air temperature state is a maximum value MAX1 which is obtained when the cooling water temperature is increased to this upper limit temperature.

Thus, when the discharge flow rate of electric water pump 40 is increased after the cooling water temperature has been increased to near the upper limit temperature, the rate of heat radiation Q can be increased higher than the maximum value MAX1 for when the discharge flow rate of electric water pump 40 is maintained unchanged, while limiting the cooling water temperature to a level that ensures the occurrence of abnormal combustion is reduced or prevented. This allows the hydraulic oil temperature to be further increased, thus promoting its friction reducing effect.

In other words, the target temperatures TTL1, TTL2 (with an increase of ΔT) set in step S104 for the use during the low external air temperature state fall within a range that ensures the occurrence of abnormal combustion is sufficiently reduced or prevented, and a greater rate of heat radiation Q than what obtained solely by such temperature setting can be achieved by additionally increasing the discharge flow rate of electric water pump 40 (circulation flow rate of the cooling water).

Figure 4:
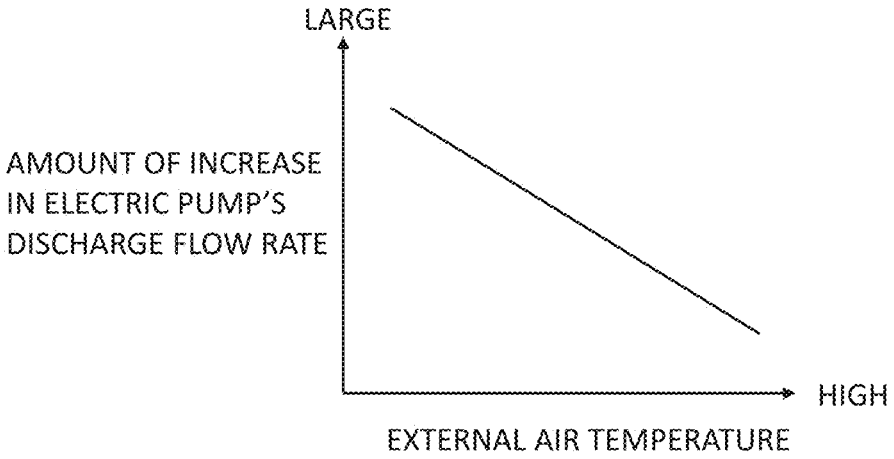
FIG. 4 is a graph illustrating correlation between the external air temperature and the amount of increase in the discharge flow rate of the electric water pump according to an embodiment of the present invention.

The lower the external air temperature, the less easily the temperatures in internal combustion engine 10 such as hydraulic oil temperature increase. Accordingly, as in the characteristics of FIG. 4, the discharge flow rate of electric water pump 40 (circulation flow rate of the cooling water) can be increased by a greater amount the lower the external air temperature is.

Increasing the discharge flow rate of electric water pump 40 as the external air temperature decreases as described above has the following advantages: reducing or preventing a needless increase in electric power consumption which is caused by unnecessarily increasing the discharge flow rate of electric water pump 40 when the external air temperature is relatively high; and reducing or preventing deterioration in heating performances of the heat exchangers even when the external air temperature is low.

The discharge flow rate of electric water pump 40 may be increased to a target value stepwisely or gradually.

Moreover, during the low external air temperature state, controlling the cooling water temperature and the discharge flow rate of electric water pump 40 in a similar manner as during the high external air temperature state will result in a lower lubricating oil temperature in internal combustion engine 10 than that during the high external air temperature state, thus increasing friction in internal combustion engine 10 and deteriorating the fuel economy.

In contrast, increasing the cooling water temperature during the low external air temperature state as described above makes it possible to increase the lubricating oil temperature close to that during the high external air temperature state, thus reducing friction in internal combustion engine 10 and improving the fuel economy.

After the completion of the engine warm-up, electronic control device 100 may perform processing for increasing the discharge flow rate of electric water pump 40 in parallel to the process of increasing the cooling water temperature to the target temperature for during the low external air temperature state. However, increasing the discharge flow rate of electric water pump 40 in parallel to the process of increasing the cooling water temperature may possibly decelerate the temperature rise of the cooling water. To avoid this, it is preferable to increase the discharge flow rate of electric water pump 40 after the cooling water temperature has increased to a predetermined temperature.

As described above, by performing the processing in steps S101 to S108, electronic control device 100 achieves the following during the low external air temperature state. First, when the warm-up of internal combustion engine 10 is completed, electronic control device 100 decreases the circulation rate of the cooling water flowing by way of radiator 50 so as to increase the cooling water temperature from when the engine warm-up is just completed. Then, when the cooling water temperature reaches the target temperature for during the low external air temperature state, electronic control device 100 increases the discharge flow rate of electric water pump 40 so as to increase the rate of heat radiation from the heat exchangers by increasing both the cooling water temperature and the circulation flow rate of the cooling water.

At the time of increasing the discharge flow rate of electric water pump 40, electronic control device 100 raises the flag F. Accordingly, in the next and succeeding cycles of the interrupt processing, the operation proceeds from step S103 to step S109. In step S109 and subsequent steps, electronic control device 100 performs processing for maintaining the target temperature for during the low external air temperature state.

In step S109, electronic control device 100 determines whether the cooling water temperatures TW1, TW2 are below lower limit temperatures MINL1, MINL2, which are lower respectively than the target temperatures TTL1, TTL2 by a predetermined temperature difference ΔTL. In other words, electronic control device 100 determines whether the cooling water temperatures TW1, TW2 have been no longer maintained at the target temperatures TTL1, TTL2, and decrease by the predetermined temperature difference or more.

In step S109, electronic control device 100 can compare the cooling water temperatures TW1, TW2 respectively with the lower limit temperatures MINL1, MINL2 in a similar manner as in step S106.

When it is determined that the cooling water temperatures TW1, TW2 are below their respective lower limit temperatures MINL1, MINL2, the operation proceeds to step S110. In step S110, electronic control device 100 performs processing for decreasing the discharge flow rate of electric water pump 40.

In step S110, electronic control device 100 may stepwisely decrease the discharge flow rate of electric water pump 40 to the discharge flow rate for during the high external air temperature state (normal discharge flow rate), stepwisely decrease the discharge flow rate of electric water pump 40 by a predetermined value, or gradually decrease the discharge flow rate of electric water pump 40.

When electronic control device 100 has decreased the discharge flow rate of electric water pump 40 to a desired value, the operation proceeds to step S111. In step S111, electronic control device 100 determines whether the cooling water temperatures TW1, TW2 have increased to near their target temperatures TTL1, TTL2.

Until the cooling water temperatures TW1, TW2 have increased back to near their target temperatures TTL1, TTL2, the operation returns to step S110, in which electronic control device 100 maintains the discharge flow rate of electric water pump 40 at a flow rate smaller than the target flow rate for during the low external air temperature state.

When the cooling water temperatures TW1, TW2 have increased to near their target temperatures TTL1, TTL2 as a result of the reduced cooling performance of electric water pump 40 due to its decreased discharge flow rate, the operation proceeds from step S111 to step S108. In step S108, electronic control device 100 increases the discharge flow rate of electric water pump 40 back to the flow rate greater than the normal discharge flow rate for during the high external air temperature state by the predetermined value.

When electronic control device 100 determines that the cooling water temperatures TW1, TW2 are above their respective lower limit temperatures MINL1, MINL2 in step S109, the operation proceeds to step S112. In step S112, electronic control device 100 determines whether the cooling water temperatures TW1, TW2 are above upper limit temperatures MAX1, MAX2, which are higher respectively than the target temperatures TTL1, TTL2 by a predetermined temperature difference ΔTH.

In step S112, electronic control device 100 can compare the cooling water temperatures TW1, TW2 respectively with the upper limit temperatures MAX1, MAX2 in a similar manner as in step S106.

When it is determined that the cooling water temperatures TW1, TW2 are below their respective upper limit temperatures MAX1, MAX2; in other words, each of the cooling water temperatures TW1, TW2 falls within a predetermined temperature range including its target temperature TTL1, TTL2, this routine ends immediately. Thereby, electronic control device 100 increases the discharge flow rate of electric water pump 40 as compared to during the high external air temperature state, and maintains the circulation rate of the cooling water flowing by way of radiator 50 at a level lower than that during the high external air temperature state.

On the other hand, when it is determined that the cooling water temperatures TW1, TW2 are above their respective upper limit temperatures MAX1, MAX2; in other words, the cooling water temperatures has been excessively increased, the operation proceeds to step S113. In step S113, electronic control device 100 performs processing for increasing the circulation rate of the cooling water flowing by way of radiator 50 by a predetermined value by controlling the rotor angle of flow rate control valve 30.

In step S113, electronic control device 100 may stepwisely change the circulation rate of the cooling water flowing by way of radiator 50 to the target flow rate for during the high external air temperature state (stepwisely change the rotor angle of flow rate control valve 30 to the controlled angle), stepwisely decrease the circulation rate of the cooling water flowing by way of radiator 50 by a predetermined value, or gradually decrease the circulation rate of the cooling water flowing by way of radiator 50.

Increasing the flow rate of the cooling water circulating by way of radiator 50 leads to a relative decrease in the flow rate of the cooling water circulating bypassing radiator 50. This increases the cooling performance of the cooling device, which thus can decrease the cooling water temperature.

After electronic control device 100 has increased the circulation rate of the cooling water flowing by way of radiator 50, the operation proceeds to step S114. In step S114, electronic control device 100 determines whether the cooling water temperatures TW1, TW2 have decreased to near their target temperatures TTL1, TTL2.

Until the cooling water temperatures TW1, TW2 have decreased to near their target temperatures TTL1, TTL2, the operation returns to step S113, in which electronic control device 100 maintains the circulation rate of the cooling water flowing by way of radiator 50 at this increased level.

When the cooling water temperatures TW1, TW2 have decreased to near their target temperatures TTL1, TTL2 as a result of the increased circulation rate of the cooling water flowing by way of radiator 50, the operation proceeds to step S115. In step S115, electronic control device 100 decreases the circulation rate of the cooling water flowing by way of radiator 50 back to the level lower than that during the high external air temperature state.

As described above, after the warm-up of internal combustion engine 10 is completed during the low external air temperature state, the cooling water temperatures TW1, TW2 are maintained near their target temperatures TTL1, TTL2 for during the low external air temperature state. This prevents excessive decreases in the cooling water temperatures TW1, TW2, thus reducing or preventing significant deterioration in heating performances of the heat exchangers for heating such as heater core 91, as well as prevents excessive rises in the cooling water temperatures TW1, TW2, thus reducing or preventing the occurrence of abnormal combustion in internal combustion engine 10.

Figure 5:
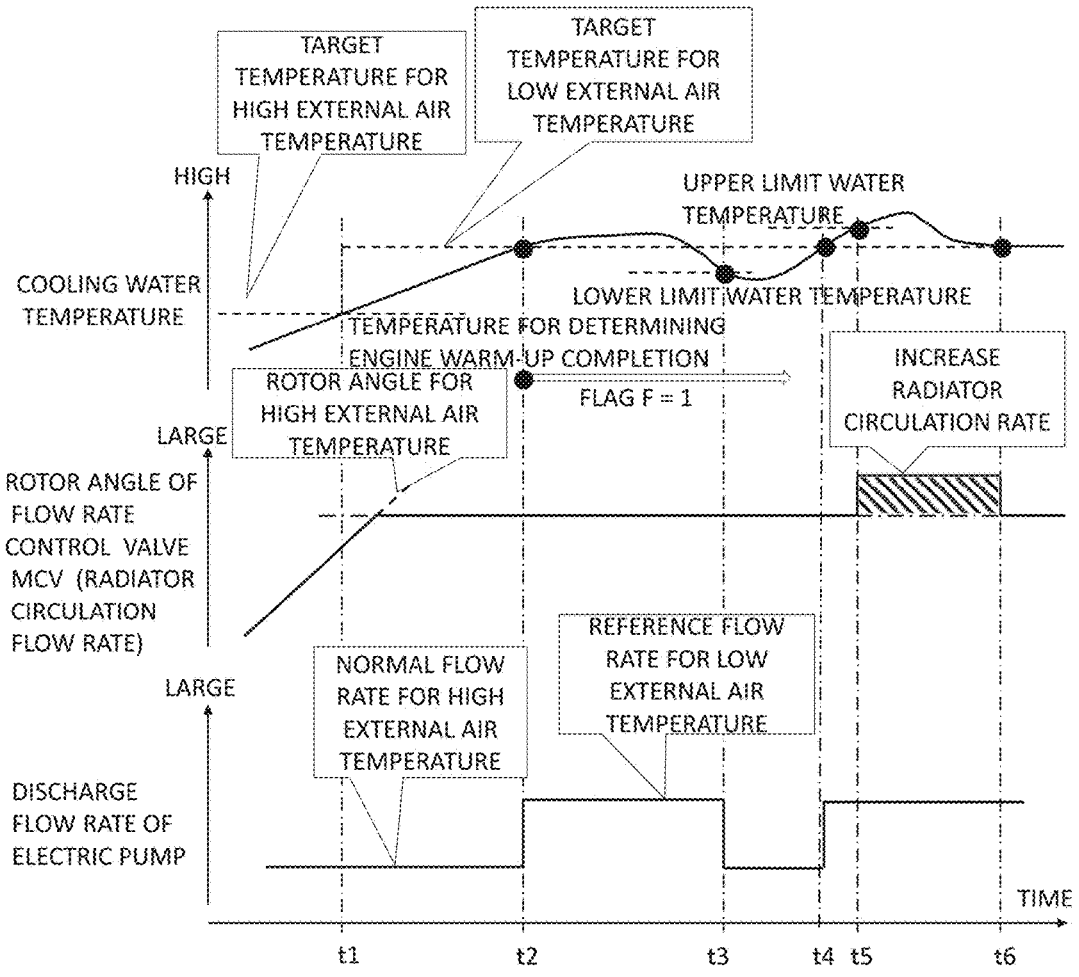
FIG. 5 is a time chart illustrating exemplary changes of the cooling water temperature, the rotor angle of the flow rate control valve, and the discharge flow rate of the electric water pump during the low external air temperature state, according to an embodiment of the present invention.

The time chart of FIG. 5 illustrates exemplary changes of the cooling water temperature, the rotor angle of flow rate control valve 30, and the discharge flow rate of electric water pump 40 when electronic control device 100 performs the routine illustrated in the flowchart of FIG. 3 during the low external air temperature state.

In the time chart of FIG. 5, the cooling water temperature reaches a warm-up completion temperature (target temperature for during the high external air temperature state) at time point t1. In response, to further increase the cooling water temperature, electronic control device 100 limits increase of the rotor angle of flow rate control valve 30 to a smaller level than during the high external air temperature state, and decreases the flow rate of the cooling water circulating by way of radiator 50 as compared to during the high external air temperature state.

As a result of the control for limiting the radiator circulation rate described above, the cooling water temperature reaches the target temperature for during the low external air temperature state at time point t2. In response, electronic control device 100 increases the discharge flow rate of electric water pump 40 as compared to during the high external air temperature state.

Then, at time point t3, the cooling water temperature falls below the lower limit water temperature, which is lower than the target temperature for during the low external air temperature state. In response, electronic control device 100 decreases the discharge flow rate of electric water pump 40 to increase the cooling water temperature. When the cooling water temperature increases back to the target temperature for during the low external air temperature state at time point t4, electronic control device 100 increases the discharge flow rate of electric water pump 40.

Then, at time point t5, the cooling water temperature increases above the upper limit water temperature, which is higher than the target temperature for during the low external air temperature state. In response, electronic control device 100 increases the rotor angle of flow rate control valve 30 to increase the flow rate of the cooling water circulating by way of radiator 50, thereby causing a relative decrease in the flow rate of the cooling water circulating bypassing radiator 50 so as to decrease the cooling water temperature.

When the cooling water temperature decreases back to the target temperature for during the low external air temperature state at time point t6, the electronic control device 100 decreases the rotor angle of flow rate control valve 30 so as to decrease the flow rate of the cooling water circulating by way of radiator 50.

Although the invention has been described in detail with reference to the preferred embodiment, it is apparent that the invention may be modified into various forms by one skilled in the art based on the fundamental technical concept and teachings of the invention.

For example, flow rate control valve 30 is not limited to a rotor type. For example, a flow rate control valve having a structure that includes a valve element configured to be linearly moved by an electric actuator may alternatively be used.

Moreover, only heater core 91 may be disposed on fourth cooling water pipe 74 (third cooling water line). Still alternatively, in addition to heater core 91, any one or two of EGR cooler 92, exhaust gas recirculation control valve 93 and throttle valve 94 may be disposed on fourth cooling water pipe 74 (third cooling water line).

The passages connecting block cooling water passage 62 to head cooling water passage 61 do not have to be provided in the interior of internal combustion engine 10, and another piping configuration may be employed instead. In an alternative piping configuration, an inlet of block cooling water passage 62 is formed in cylinder block 12 and seventh cooling water pipe 77 branches into two pipes in the middle thereof. One of these branch pipes is connected to head cooling water passage 61 and the other branch pipe is connected to block cooling water passage 62.

In the cooling device, among the first to fourth cooling water lines, either the third cooling water line (heater core line) or the fourth cooling water line (the power train system line, transmission line, and oil warmer line) may be omitted.

Moreover, the cooling device may have a configuration in which oil cooler 16 is not disposed on the second cooling water line.

An auxiliary electric water pump may be disposed on eighth cooling water pipe 78. A mechanically driven water pump, which is driven by internal combustion engine 10, may be provided in parallel to electric water pump 40.

Furthermore, the present invention may also be applied to a cooling device including: a main flow channel through which the cooling water circulates by way of an internal combustion engine and a radiator; a bypass flow channel that branches off from the main flow channel and bypasses the radiator; and a flow rate control valve for controlling the opening area of the bypass flow channel so as to control the flow rate of the cooling water through the bypass flow channel.

Here, technical concepts which can be grasped from the above embodiments will be described below.

According to an aspect of a cooling device of an internal combustion engine for vehicle, during a low external air temperature state where an external air temperature is below a threshold, the cooling device increases a circulation flow rate of cooling water as well as a temperature of the cooling water as compared to during a high external air temperature state where the external air temperature is above the threshold.

According to a preferred aspect, the cooling device comprises: a radiator; a bypass line through which the cooling water circulates bypassing the radiator; a flow rate control valve for regulating a flow rate of the cooling water circulating through the bypass line; an electric water pump for circulating the cooling water; and a control unit for controlling the flow rate control valve and the electric water pump, wherein, during the low external air temperature state, the control unit increases the flow rate of the cooling water circulating through the bypass line and a discharge flow rate of the electric water pump as compared to during the high external air temperature state.

According to another preferred aspect, the control unit increases the discharge flow rate of the electric water pump by a greater amount the lower the external air temperature is.

According to still another preferred aspect, the control unit decreases the flow rate of the cooling water circulating through the bypass line when the temperature of the cooling water exceeds an upper limit water temperature after having reached a second target water temperature for during the low external air temperature state, the upper limit water temperature being higher than the second target water temperature, the second target water temperature being higher than a first target water temperature for during the high external air temperature state.

According to still another preferred aspect, the control unit increases the discharge flow rate of the electric water pump after the temperature of the cooling water has reached a second target water temperature for during the low external air temperature state, which is higher than a first target water temperature for during the high external air temperature state.

According to still another preferred aspect, the control unit decreases the discharge flow rate of the electric water pump when, after the discharge flow rate of the electric water pump is increased, the temperature of the cooling water falls below a lower limit water temperature, which is lower than the second target water temperature.

According to still another preferred aspect, the cooling device further comprises a heat exchanger for heating in a circulation passage of the cooling water.

According to still another preferred aspect, the cooling device further comprises: a first cooling water line routed by way of a cylinder head of the internal combustion engine and the radiator; a second cooling water line routed by way of a cylinder block of the internal combustion engine while bypassing the radiator; a third cooling water line routed by way of the cylinder head and a heater core for vehicle air heating while bypassing the radiator; and a fourth cooling water line routed by way of the cylinder head and a power train system of the internal combustion engine while bypassing the radiator, wherein the flow rate control valve has inlet ports respectively connected to the first cooling water line, the second cooling water line, the third cooling water line, and the fourth cooling water line, and an outlet port connected to an intake of the electric water pump, and wherein the bypass line branches off from the first cooling water line at a point between the cylinder head and the radiator, and connects with the outlet port of the flow rate control valve while bypassing the radiator.

According to an aspect of a control method for a cooling device of an internal combustion engine for vehicle, the control method is for controlling the cooling device comprising: an electric water pump for circulating cooling water; a bypass line bypassing a radiator; and a flow rate control valve for controlling a flow rate of the cooling water circulating through the bypass line, the control method comprising the steps of: increasing a temperature of the cooling water during a low external air temperature state where an external air temperature is below a threshold as compared to during a high external air temperature state where the external air temperature is above the threshold, by controlling the flow rate control valve so as to increase the flow rate of the cooling water circulating through the bypass line during the low external air temperature state as compared to during the high external air temperature state; and increasing a circulation flow rate of the cooling water during the low external air temperature state as compared to during the high external air temperature state by increasing a discharge flow rate of the electric water pump during the low external air temperature state as compared to during the high external air temperature state.

REFERENCE SYMBOL LIST

10 internal combustion engine
11 cylinder head
12 cylinder block
16 oil cooler
20 transmission (power train system)
21 oil warmer
30 flow rate control valve
31 to 34 inlet port
35 outlet port
40 electric water pump
50 radiator
61 head cooling water passage
62 block cooling water passage
71 first cooling water pipe
72 second cooling water pipe
73 third cooling water pipe
74 fourth cooling water pipe
75 fifth cooling water pipe
76 sixth cooling water pipe
77 seventh cooling water pipe
78 eighth cooling water pipe
81 first temperature sensor
82 second temperature sensor

91 heater core
92 EGR cooler
93 exhaust gas recirculation control valve
94 throttle valve
100 electronic control device

The invention claimed is:

1. A cooling device of an internal combustion engine for vehicle, the cooling device comprising:

a radiator;

a bypass line through which cooling water circulates bypassing the radiator;

a flow rate control valve for regulating a flow rate of the cooling water circulating through the bypass line;

an electric water pump for circulating the cooling water; and a control unit for controlling the flow rate control valve and the electric water pump, wherein, during a low external air temperature state where an external air temperature is below a threshold, the control unit increases a temperature of the cooling water as compared to during a high external air temperature state where the external air temperature is above the threshold by controlling the flow rate control valve so as to increase the flow rate of the cooling water circulating through the bypass line as compared to during the high external air temperature state, and increases a circulation flow rate of the cooling water as compared to during the high external air temperature state by increasing a discharge flow rate of the electric water pump as compared to during the high external air temperature state, and wherein, during the low external air temperature state, the control unit increases the discharge flow rate of the electric water pump after the temperature of the cooling water has reached a second target water temperature for during the low external air temperature state, which is higher than a first target water temperature for during the high external air temperature state.

2. The cooling device of the internal combustion engine for vehicle according to claim 1, wherein the control unit increases the discharge flow rate of the electric water pump by a greater amount the lower the external air temperature is.

3. The cooling device of the internal combustion engine for vehicle according to claim 1, wherein the control unit decreases the flow rate of the cooling water circulating through the bypass line when the temperature of the cooling water exceeds an upper limit water temperature after having reached the second target water temperature, the upper limit water temperature being higher than the second target water temperature.

4. The cooling device of the internal combustion engine for vehicle according to claim 1, wherein the control unit decreases the discharge flow rate of the electric water pump when, after the discharge flow rate of the electric water pump is increased, the temperature of the cooling water falls below a lower limit water temperature, which is lower than the second target water temperature.

5. The cooling device of the internal combustion engine for vehicle according to claim 1, further comprising a heat exchanger for heating in a circulation passage of the cooling water.

6. The cooling device of the internal combustion engine for vehicle according to claim 1, further comprising:

a first cooling water line routed by way of a cylinder head of the internal combustion engine and the radiator;

a second cooling water line routed by way of a cylinder block of the internal combustion engine while bypassing the radiator;

a third cooling water line routed by way of the cylinder head and a heater core for vehicle air heating while bypassing the radiator; and a fourth cooling water line routed by way of the cylinder head and a power train system of the internal combustion engine while bypassing the radiator, wherein the flow rate control valve has inlet ports respectively connected to the first cooling water line, the second cooling water line, the third cooling water line, and the fourth cooling water line, and an outlet port connected to an intake of the electric water pump, and wherein the bypass line branches off from the first cooling water line at a point between the cylinder head and the radiator, and connects with the outlet port of the flow rate control valve while bypassing the radiator.

7. A control method for a cooling device of an internal combustion engine for vehicle, the cooling device comprising: an electric water pump for circulating cooling water; a bypass line bypassing a radiator; and a flow rate control valve for controlling a flow rate of the cooling water circulating through the bypass line, the control method comprising the steps of:

increasing a temperature of the cooling water during a low external air temperature state where an external air temperature is below a threshold as compared to during a high external air temperature state where the external air temperature is above the threshold, by controlling the flow rate control valve so as to increase the flow rate of the cooling water circulating through the bypass line during the low external air temperature state as compared to during the high external air temperature state; and increasing a circulation flow rate of the cooling water during the low external air temperature state as compared to during the high external air temperature state by increasing a discharge flow rate of the electric water pump during the low external air temperature state as compared to during the high external air temperature state, wherein the step of increasing the circulation flow rate of the cooling water includes increasing the discharge flow rate of the electric water pump after the temperature of the cooling water has reached a second target water temperature for during the low external air temperature state, which is higher than a first target water temperature for during the high external air temperature state.

* * * * *